United States Patent [19]

Schinke

[11] 4,019,217

[45] Apr. 26, 1977

[54] CLEANING APPARATUS FOR ROLLERS

[75] Inventor: Otto Schinke, Bruchmuehlen-Roedinghausen, Germany

[73] Assignee: Theodor Hymmen KG, Bielefeld, Germany

[22] Filed: Dec. 1, 1975

[21] Appl. No.: 636,574

[30] Foreign Application Priority Data

Nov. 29, 1974 Germany ..... 2456401

[52] U.S. Cl. ..... 15/256.53; 118/203

[51] Int. Cl.[2] ..... D21G 3/02

[58] Field of Search ..... 15/256.53, 256.51; 118/104, 203; 101/425; 355/15

[56] References Cited

UNITED STATES PATENTS

| | | | |
|---|---|---|---|
| 2,977,927 | 4/1961 | Mehler et al. | 118/203 |
| 3,144,826 | 8/1964 | Lang et al. | 101/425 |

FOREIGN PATENTS OR APPLICATIONS

| | | | |
|---|---|---|---|
| 968,638 | 9/1964 | United Kingdom | 101/425 |

*Primary Examiner*—Edward L. Roberts
*Attorney, Agent, or Firm*—Dennison, Dennison, Meserole & Pollack

[57] ABSTRACT

In a machine for application of liquid compositions to workpieces by means of longitudinally extending applicator rollers, cleaning apparatus comprising at least one cleaning member for each application roller and mounting means for the cleaning member adapted to enable such to be moved into contact with the application roller and moved out of range of the application roller; each said cleaning member being adapted to be reciprocated in longitudinal extension of the application roller.

8 Claims, 3 Drawing Figures

CLEANING APPARATUS FOR ROLLERS

The present invention relates to a cleaning apparatus for rollers on a machine for the application of particularly viscous compositions such as glue, varnish or the like.

In known application machines, the rollers thereof have hitherto been manually cleaned in a time-consuming and cumbersome manner with brushes and cleaning agents, which is extremely complex for a satisfactory cleaning. There also exists the risk of accident and damage since the operator cleans the rollers with a brush while such rotate and the operator frequently drops the brush which is then drawn into the rollers and which causes damage to the rollers. If the operator attempts to pull the brush out, he may suffer injuries to his hands and arms.

It is an object of the invention to provide in a machine for application of liquids to workpieces or the like, a cleaning apparatus which while avoiding manual cleaning operations, cleans the rollers of the machine in a simple, rational and satisfactory manner; this cleaning apparatus is intended to eliminate or minimize damage to the rollers and the accident risk.

The cleaning apparatus which is to be arranged on or which is arranged on an application machine should be of simple and economic structure and should satisfactorily clean the whole outer surface of the application rollers while such rotate.

Moreover, the cleaning apparatus should be located on the application machine so as not to impair the application operations and for the cleaning process to be carried out and brought into contact with the application rollers by easy handling.

In accordance with the invention, a cleaning apparatus for rollers on machines used for applying liquid (viscous) compositions such as varnish, glue or the like has a cleaning member, such as a brush, sponge member or the like for each application roller, with each cleaning member being adapted to be brought into contact with the application roller and removable from the region of the application roller, and being adapted to be reciprocated in the longitudinal extension of the application roller by a displacing device.

On a carrier part of the cleaning apparatus, two spaced apart brush-shaped cleaning members are secured for the simultaneous cleaning of two coating rollers such as e.g. a dosing and an application roller, and this carrier part is retained to be vertically reciprocatable by at least one rocker arm on a displacing member connected with the traction member and extending parallel to the longitudinal extension of the application rollers.

The cleaning apparatus for two application rollers located above the plane of passage of the workpiece is provided with a carrier member with two cleaning members, and for two application rollers located below the passage plane of the workpiece, a carrier member with two cleaning members and two carrier members are also mounted so as to be vertically pivoted by means of their rocker levers on a common displacing member; each carrier member being connected to a supply pipe for the cleaning agent, such as hot water with cleaning additive.

The guide beam may be formed by a polyhedral pipe, such as a square pipe, or a U-shaped profile and the displacing member may be formed by a carriage or a slide which is guided and displaceable along the guide beam or strut.

The displacing member is preferably connected to the traction member formed by an endless chain revolving about two machine-mounted reversing rollers, an endless revolving belt or an endless revolving cable and a reversing roller is motionally coupled to a power drive, such an electric motor mounted on the machine frame.

The two levers pivotally mounted on the displacing member may be secured in position in the vertically pivoted inoperative position by being locked together.

The cleaning apparatus in accordance with the invention permits in a simple and rational manner a satisfactory cleaning of the application rollers of application media (glue, varnish or the like) adhering thereto and eliminates the hitherto known costly and cumbersome manual cleaning operations.

The invention will be described further, by way of example, with reference to the accompanying drawings, in which.

Figure 1:
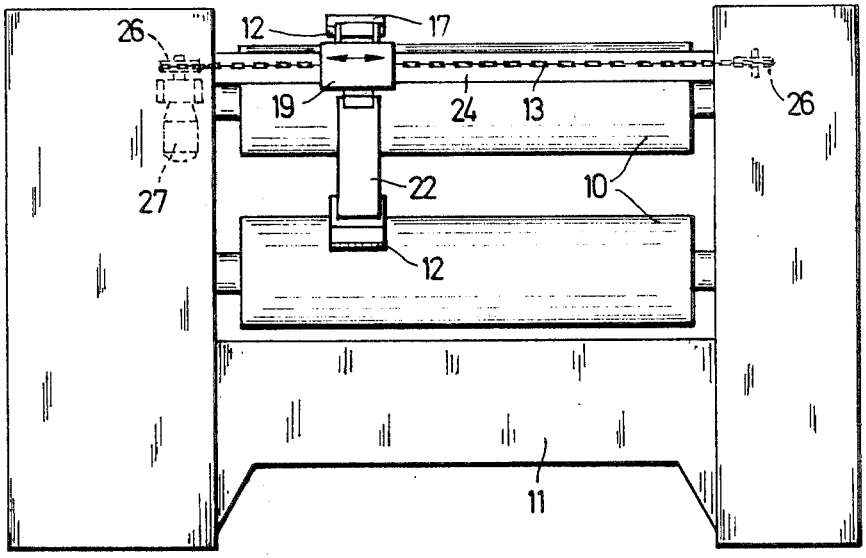
FIG. 1 is an end view of an application machine having a cleaning apparatus associated with the application rollers.
Figure 3:
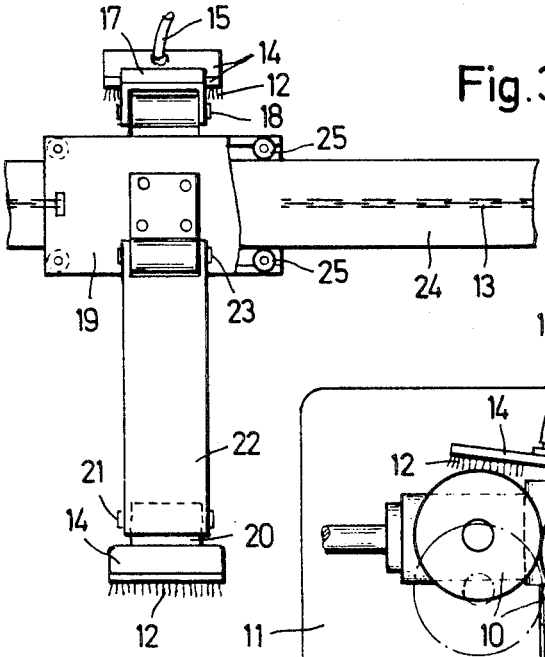
FIG. 3 is an end view of the cleaning apparatus.

A cleaning apparatus is shown in accordance with the invention for cleaning rollers 10 of a machine 11 for applying liquid, more especially viscous compositions such as glue, varnish or the like. The cleaning apparatus has a cleaning member 12 for each application roller 10; said cleaning member 12 being in the form of, for example, a brush, sponge member or the like adapted to be moved into and out of the region of the roller 10 and adapted to be reciprocated by a traction member (displacement device) shown as an endless chain 13 in the longitudinal extension of the application roller 10.

Preferably two spaced apart cleaning members 12 are located on a carrier part or plate 14 so that two co-operating rollers 10 which form a dosing and an application roller can be simultaneously cleaned with the two cleaning members 12. The carrier plate 14 communicates with a cleaning agent supply pipe 15 so that the cleaning members 12 clean the rollers 10 with this cleaning liquid which may, for example, be hot water with cleaning additives (chemical agents).

Figure 2:
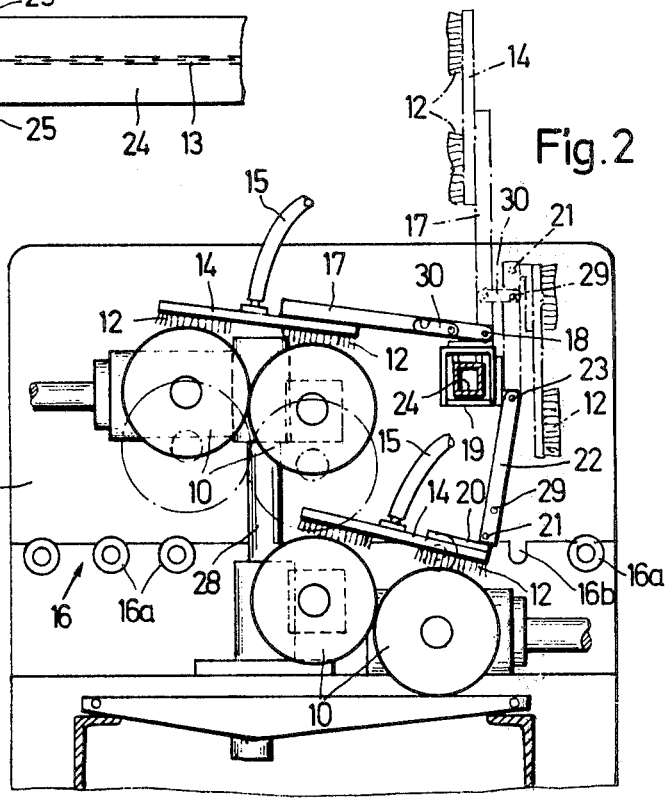
FIG. 2 is a side view of the application machine having a cleaning apparatus in the operative position and shown in the inoperative position in chain-dotted lines.

As shown in FIG. 2 of the drawings, the application machine is provided above and below the plane of passage of the workpiece which plane, for example, is formed by a roller track 16 with two co-operating rollers 10 as dosing roller and application roller and each two co-operating rollers 10 are cleaned simultaneously by cleaning members 12 located on a carrier plate 14.

The upper plate-shaped carrier part 14 with its two cleaning members 12 is secured to a pivot lever 17 which is mounted at its end remote from the carrier plate 14 so as to be vertically reciprocated on a pivot 18 having a pivotal axis extending parallel to the longitudinal axis of the rollers and mounted on a displacement member 19 formed by a carriage, slide or the like. The lower plate-shaped carrier part 14 with its two cleaning members 12 is mounted on a lever 20 which is in connection via a pivot 21 (preferably having a pivotal axis extending parallel to the longitudinal axis of the application rollers) to a rocking lever 22; one end of the lever 22 hingledly engages the carrier part lever 20 and is retained at its other end to be verticaly reciprocatable in a pivot 23, especially as pivotal axis extending parallel to the longitudinal axis of the rollers, on the displacement memeber 19.

The displacement member 19 is displaceably mounted on a guide strut 24 extending in parallel to the longitudinal axis of the application rollers 10. Both carrier plates 14 are hence retained via their levers 17 or 20, 22 on a common displacement member 19 and mutually displaceable so that the two upper and two lower rollers 10 are simultaneously cleaned.

The guide strut 24 is formed, for example, by a tube having an angular, e.g. square cross-section, or by a U-shaped profile and the displacement member 19 adapted as a U-shaped profile or C-shaped profile overlapping this guide strut which by interposition of sliding and/or elements 25 such as rollers, is displaceably mounted and guided on the guide strut 24.

The displacement member 19 is connected to the traction member 13 formed by an endless revolving belt, endless revolving cable or the like, whereby the traction member 13 is guided outside the longitudinal ends of the rollers 10 by way of reversing roller (pulleys) 26 or the like mounted on the machine frame 11. In the region of a reversing wheel 26, a drive motor 27 (e.g. an electric motor) is located on the machine frame 11 and causes the reciprocating displacement movement of the traction member 13. It is also within the scope of the invention to form the traction member 13 by a chain, a cable, a belt or the like which is connected with one end on a spring-loaded drum with the drive 27, so that for the movement of the traction member one end is unwound or wound-up by the spring-loaded drum and the other end being unwound or wound up on the motor-driven drum.

It is also possible for the displacement member 19 to mesh with a motor-driven gearwheel in a stationary racked bar.

For cleaning the application rollers 10 of adhering application agents, the two upper rollers 10 are lifted to a certain extent via a machine-side lifting device 28, such as a pressure medium cylinder. The upper carrier part 14 is then pivoted by hand downwards onto the upper rollers 10 by means of its pivot lever 17 so that a cleaning member 12 rests on each upper roller 10. The lower carrier part 14 is then pivoted by hand downwards by means of its two levers 22, 20 so that the latter also rests with each of its cleaning members 12 on a lower roller 10. The upper rollers 10 moved vertically upwards thus permit the lower carrier part 14 to be pivoted past the upper rollers 10. In order, however, to permit the lower rollers 10 to be cleaned by the downward pivotal movement of the lower carrier part 14 it is necessary for individual rollers **16*a* of the roller track 16 to be removed so that the lower rollers 10 in their region for the abutment of the carrier part 14 have no rollers 16*a* and the lower rollers 10** to be exposed.

The drive motor 27 is now cut in and the displacement member 19 reciprocated via the traction member 13. The cleaning members 12 are in contact with the rollers 10 and due to their reciprocating displacement they thereby clean the rotating rollers 10 of adhering application composition and the cleaning operation is further promoted by the cleaning fluid passing through the cleaning members 12.

When the cleaning process has ended, the upper carrier part 14 and its two cleaning members 12 is pivoted upwards by hand so that the pivot lever 17, assuming a substantially vertical position, is moved out of the range of the upper rollers 10. The lower carrier part 14 is also pivoted upwards by its lever 20 about the pivotal axis 21 so that the lever 20 abuts against the pivot lever 22 and now both levers 20, 22 are pivoted about the pivotal axis 20 upwardly against the pivotal movement of the lever 20 so that lever 22 also assumes a substantially vertical position; the lever 20 still abutting against the lever 22 and the carrier part 14 being suspended substantially vertically.

The levers 17 and 22 of both carrier parts 14 are spaced apart and are interconnected by an arresting member, such as a hook 30 or the like, pivotally mounted on the lever 17 and detachably engaging the other lever 22 via a pin 29 in the non-operative position to be thereby secured to each other, the lever 22 abutting against the displacement member 19 and both levers 22 and 17 being held together by the location 29 and 30 can be pivoted downwards therewith.

If the carrier parts 14 are moved to the non-operational position, the rollers **16*a* in the region of the lower rollers 10 may again be inserted in the receptacles 16*b* of the roller track 16 and the upper rollers 10** may again be lowered onto the given workpiece thickness.

To cause the cleaning apparatus to resume the operational position for cleaning, the arresting means (29 and 30) is released and the lever 17 together with the carrier part 14 and cleaning members 12 is pivoted downwards about the axis 18 and onto the lower rollers 10 and the pivot lever 22 pivoted against the direction of pivot of the lever 17 downwards about the axle 23 through more than 180°. The lever 20 with the carrier part 14 and the cleaning members 12 is then pivoted downwards against the pivotal movement of the lever 22 onto the lower rollers 10.

What I claim:

1. In a machine for application of viscous liquid compositions by means of a plurality of longitudinally extending applicator rollers, the improvement comprising apparatus on said machine for cleaning said rollers, said apparatus comprising a resilient nonrigid cleaning element for each roller, linkage means interconnecting each element to said machine to permit said element to be selectively brought from a storage position to a cleaning position adjacent its roller, and displacement means for moving said elements longitudinally along said rollers.

2. In a machine as defined in claim 1 wherein said cleaning elements are brushes and wherein a pair of brushes, one for each of two rollers, are mounted on a common carrier plate, said linkage means comprising a lever connected to said carrier plate at one end and pivotally connected at its other end to a carriage member, said pivotal connection being along an axis parallel to said rollers, and a guide strut on said machine extending parallel to said rollers, said carriage member being slideably engaged on said strut and said displacement means acting on said carriage member.

3. In a machine as defined in claim 2 and further including a second pair of brushes, one for each of two additional applicator rollers, mounted below said first pair of brushes having linkage means connected to said carriage member.

4. In a machine as defined in claim 3 and further including a supply pipe for a cleaning agent connected to each pair of brushes.

5. In a machine as defined in claim 3 wherein said linkage means for said second pair of brushes comprises a second carrier plate to which said brushes are attached, a second lever pivotally connected at one end to said carriage member along an axis parallel to said rollers and pivotally connected at its other end to said second carrier plate.

6. A machine as defined in claim 5 and further including hook means on one of said first or second levers and pin means on said other lever adapted to be engaged to lock said pairs of brushes in their storage position.

7. In a machine as defined in claim 2 wherein said carriage member embraces said guide strut, and roller means between said carriage member and guide strut.

8. In a machine as defined in claim 1 wherein said displacement means comprises an endless drive chain connected to said elements, motor means for imparting movement to said drive chain, and pulley means to support and guide said drive chain.

* * * * *